350-418 SR
XR 4,065,016
CROSS REFERENCE
SEARCH ROOM

United State
Perkins 4,065,016
Dec. 27, 1977

[54] COMPOUND VESSEL

[76] Inventor: David R. Perkins, 41 Wheeler St., Gloucester, Mass. 01930

[21] Appl. No.: 754,427

[22] Filed: Dec. 27, 1976

[51] Int. Cl.[2] ..... B65D 1/04
[52] U.S. Cl. ..... 215/6; 47/41 R; 312/284; 350/179
[58] Field of Search ..... 215/1 R, 6, 99.5; 47/41 R, 66; D11/146, 152, 153, 154, 131; D7/6, 13; D30/6, 8; D6/146; 350/179; 312/210, 284

[56] References Cited

U.S. PATENT DOCUMENTS

| | | | |
|---|---|---|---|
| 53,279 | 3/1866 | Dithridge | 47/41 |
| 59,687 | 11/1866 | Waldstein | 215/1 R |
| D. 104,981 | 6/1937 | Munz | D11/153 X |
| 167,411 | 9/1875 | Rowland | 47/41 |
| 1,404,021 | 1/1922 | Gorinac | 215/6 |
| 1,556,364 | 10/1925 | Smith | 215/1 R |
| 2,046,854 | 7/1936 | Simpson | 215/1 R X |

*Primary Examiner*—Donald F. Norton
*Attorney, Agent, or Firm*—Peter L. Berger

[57] ABSTRACT

A compound vessel is provided which has many decorative and functional applications. The compound vessel is formed of a transparent material and has a spheroidal main body. The main body is comprised of spheroidal inner and outer walls with an annular space defined therebetween. The annular space constitutes an outer vessel of the compound vessel and the space contained by the inner wall constitutes an inner vessel of the compound vessel. The outer and inner walls join at one extremity of the spheroidal main body of the compound vessel to close the outer vessel and form the periphery of a generally circular mouth opening into the inner vessel, the inner vessel being otherwise closed. The outer wall terminates at an opposite extremity of the spheroidal main body of the compound vessel to form the periphery of a generally circular mouth opening into the outer vessel, the outer vessel being otherwise closed.

6 Claims, 2 Drawing Figures

4065016
OR IN 215/6

COMPOUND VESSEL

BACKGROUND OF THE INVENTION

This invention relates to a compound vessel. More particularly, this invention relates to compound vessel having many functional and decorative applications and formed of a transparent material.

In recent years there has been a great interest in using objects of nature, such as flowers, plants, rocks, mineral specimens, sea shells, seeds, pine cones and the like for decorative purposes. Consequently, there is a great demand for novel vessels for containing and displaying such objects.

It is an object of the present invention to provide such a vessel.

Other objects and advantages of the invention will be apparent from the following description.

SUMMARY OF THE INVENTION

According to the invention, there is provided a compound vessel formed of a transparent material and having spheroidal main body. The vessel comprises spheroidal inner and outer walls with an annular space defined therebetween. The annular space constitutes an outer vessel of the compound vessel and the space contained by the inner wall constitutes an inner vessel of the compound vessel. The outer and inner walls join at one extremity of the sperhoidal main body of the compound vessel to close the outer vessel and form the periphery of a generally circular mouth opening into the inner vessel, the inner vessel being otherwise closed. The outer wall terminates at the opposite extremity of the spheroidal main body of the compound vessel to form the periphery of a generally circular mouth opening into the outer vessel, the outer vessel being otherwise closed.

The vessel may also comprise a neck, the neck being generally co-axial with the mouth of the outer vessel, merging at one of its axial extremities into the outer wall and having a mouth at its other axial extremity.

All the aforementioned mouths of the vessels of the invention, whether two or three mouths, may be substantially co-axial.

Generally, the inner wall will not extend into the plane of the mouth of the outer vessel. In other words, the mouth of the outer vessel will be spaced from the mouth of the inner vessel further than any portion of the inner wall is spaced from the mouth of the inner vessel.

BRIEF DESCRIPTION OF THE DRAWINGS

The invention will now be further described by reference to specific embodiments as illustrated in the drawings, in which.

DETAILED DESCRIPTION OF PREFERRED EMBODIMENTS

Figure 1:
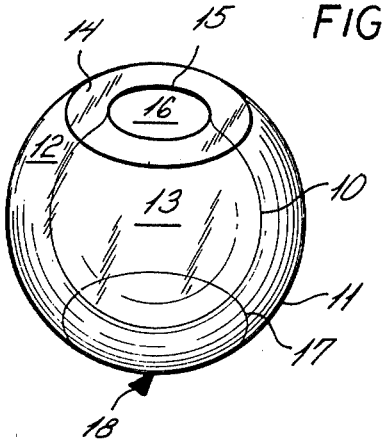
FIGS. 1 and 2 are isometric views of respective compound vessels according to the invention.

With reference to FIG. 1, it is seen that the compound vessel there illustrated has a spheroidal main body comprising spheroidal inner and outer walls 10 and 11, the vessel being formed of a transparent material such as glass or a transparent plastic. An annular space 12 is defined between the inner and outer walls 10 and 11, the annular space 12 constituting an outer vessel of the compound vessel. The inner wall 10 of the compound vessel defines a hollow interior space 13 which constitutes an inner vessel of the compound vessel. An annulus 14 of the transparent material is integral with and joins together the inner and outer walls 10 and 11. The inner periphery 15 of the annulus 14 forms the periphery of a mouth 16 opening into the inner vessel 13, the inner vessel 13 being otherwise closed. The outer wall 11 terminates at the opposite extremity of the spheroidal body of the compound vessel to form the periphery 17 of a generally circular mouth 18 opening into the outer vessel 12, the outer vessel 12 being otherwise closed. The inner wall 10 does not protrude into the plane of the mouth 18; in other words, the mouth 18 is spaced from the mouth 16 further than any portion of the inner wall 10 is spaced from the mouth 16. The mouths 16 and 18 are substantially co-axial.

The ways of using the compound vessel of FIG. 1 are limited only by the imagination of the user. For example, with the vessel in the orientation illustrated in FIG. 1, the inner vessel 13 may be partially or completely filled with soil and a plant potted therein. An interesting visual effect as if the soil were suspended in air, is thus attained. Similarly, the inner vessel may be filled with sea shells, rocks or other objects to be displayed. If the vessel is inverted from the orientation illustrated in FIG. 1, it can be used in yet other ways. For example, the mouth 16 may be placed over an object to be displayed so that the object to be displayed is contained in the inner vessel 13. The outer vessel 12 may be filled with water, which will magnify the object displayed in the inner vessel 13. At the same time, the outer vessel 12 may be used as a vase. The stems of flowers placed in the water contained therein if not too numerous, will not unduly obstruct viewing of the object displayed in the inner vessel 13. Other combinations and variations can readily be conceived.

Figure 2:
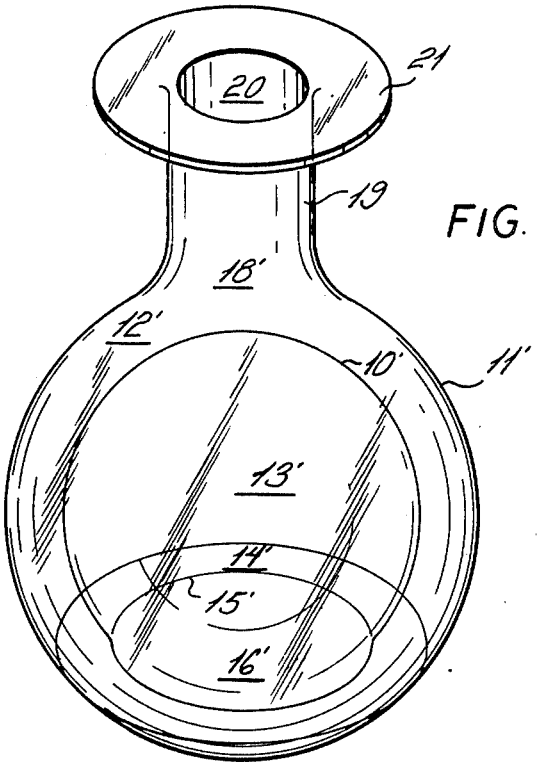

The vessel of FIG. 2 is in principle a variant of the vessel of FIG. 1 but illustrated in the inverted orientation. The variation is constituted of a neck 19 generally co-axial with the mouth 18' of the outer vessel and the mouth 16' of the inner vessel, merging at one of its axial extremities into the outer wall 11' and having a mouth 20 at its other axial extremity. A broad flange 21 integral with the neck 19 and having its upper surface in substantially the same plane as the opening 20 serves as a base for the compound vessel of FIG. 2 when that vessel is inverted. Apart from the foregoing the vessel of FIG. 2 is essentially like that of FIG. 1 and can be used in the same ways. An annular space 12' is defined between the spheroidal inner and outer walls 10' and 11', the annular space 12' constituting an outer vessel of the compound vessel. The inner wall 10' contains a space 13' constituting the inner vessel of the compound vessel. An annulus 14' at one extremity of the spheroidal main body of the compound vessel is integral with and joins the inner and outer walls 10' and 11' together. The inner periphery 15' of the annulus 14' constitutes the periphery of the generally circular mouth 16' opening into the inner vessel 13', the inner vessel 13' being otherwise closed. The generally circular cross-section of the vessel at the juncture of the neck 19 with the spheroidal main body may be considered the mouth 18' opening into the outer vessel 12', the outer vessel 12' being otherwise closed. The mouths, 20, 18' and 16' are all substantially co-axial. The inner wall 10' does not protrude into the plane of the mouth 18'. In other words, the mouth 18' is spaced from the mouth 16' further than any portion of the inner wall 10' is spaced from the mouth 16'.

While the invention has been particularly described with reference to certain specific embodiments thereof, it is to be understood that such embodiments are intended to illustrate rather than to limit the invention and that variations and modifications obvious to one of ordinary skill in the art are intended to be encompassed by the hereto appended claims.

What is claimed is:

1. A compound vessel formed of a transparent clear material and having a spheroidal main body, comprising spheroidal inner and outer walls with an annular space defined therebetween, the annular space constituting an outer vessel of the compound vessel and the interior space contained by the inner wall constituting an inner vessel of the compound vessel, the outer and inner walls joining at one extremity of the spheroidal main body of the compound vessel to close the outer vessel and form the periphery of a generally circular mouth opening into the inner vessel, said inner vessel being otherwise closed, the outer wall terminating at an opposite extremity of the spheroidal main body of the compound vessel to form the periphery of a generally circular mouth opening into the interior of the outer vessel, said outer vessel being otherwise closed said outer vessel being filled with a transparent clear liquid so that the liquid fills the outer vessel to cover the inner wall when the compound vessel is positioned upon a supporting surface, whereby the inner vessel and the supporting surface completely enclose the interior space of the inner vessel to fully enclose objects contained therein, said spheroidal shape and said liquid cooperating to magnify objects placed in the interior space viewed from any position on the exterior side of the compound vessel.

2. A compound vessel according to claim 1, comprising a neck, said neck being generally co-axial with the mouth of the outer vessel, merging at one of its axial extremities into the outer wall and having a mouth at its other axial extremity.

3. A compound vessel according to claim 2, in which the mouth of the outer vessel is spaced from the mouth of the inner vessel further than any portion of the inner wall is spaced from the mouth of the inner vessel.

4. A compound vessel according to claim 2 in which all of said mouths are substantially co-axial.

5. A compound vessel according to claim 1, in which the mouth of the outer vessel is spaced from the mouth of the inner vessel further than any portion of the inner wall is spaced from the mouth of the inner vessel.

6. A compound vessel according to claim 1, in which both of said mouths are substantially co-axial.

* * * * *